United States Patent [19]

Meyer et al.

[11] Patent Number: 5,025,731

[45] Date of Patent: Jun. 25, 1991

[54] SEGMENTED, DISCARDABLE SABOT HAVING POLYGONAL CROSS-SECTION FOR SUB-CALIBER PROJECTILE

[75] Inventors: Jürgen Meyer, Cologne; Achim Sippel, Ratingen; Monika Wildau, Korschenbroich; Heinz J. Kruse, Ratingen; Rainer Diel; Wilfried Becker, both of Düsseldorf; Gisbert Bartsch, Halle; Klaus-Dieter Pahnke, Solingen; Jürgen Huege, Düsseldorf; Hans-Werner Luther, Kaarst, all of Fed. Rep. of Germany

[73] Assignee: Rheinmetall GmbH, Dusseldorf, Fed. Rep. of Germany

[21] Appl. No.: 539,826

[22] Filed: Jun. 18, 1990

[30] Foreign Application Priority Data

Jun. 21, 1978 [DE] Fed. Rep. of Germany ..... 3920254
Feb. 17, 1990 [DE] Fed. Rep. of Germany ..... 4005127

[51] Int. Cl.[5] ..... F42B 14/06
[52] U.S. Cl. ..... 102/521
[58] Field of Search ..... 102/520, 521, 522, 523

[56] References Cited

U.S. PATENT DOCUMENTS

| | | | |
|---|---|---|---|
| 3,038,382 | 6/1962 | Noyes et al. | 102/521 |
| 3,496,869 | 2/1970 | Engel | 102/522 |
| 3,601,061 | 8/1971 | Dardick | 102/520 |
| 3,847,082 | 11/1974 | Feldmann | 102/522 |
| 4,326,464 | 4/1982 | Price | 102/523 |
| 4,444,114 | 4/1984 | Bisping et al. | 102/523 |
| 4,542,696 | 9/1985 | Bisping et al. | 102/523 |

FOREIGN PATENT DOCUMENTS

| | | | |
|---|---|---|---|
| 3704027 | 8/1988 | Fed. Rep. of Germany . | |
| 1576031 | 7/1969 | France . | |
| 143676 | 1/1954 | Sweden | 102/520 |

*Primary Examiner*—Michael J. Carone
*Attorney, Agent, or Firm*—Spencer & Frank

[57] ABSTRACT

A segmented, discardable sabot for a slender sub-caliber kinetic energy projectile. At least two sabot segments are provided having adjacent plane parallel segment separating faces and presenting at least one caliber-sized gas sealing pressure flange member and a non-caliber sized partial region along the longitudinal extent of the sabot. The overall cross section of the sabot, at least in the partial region, has an essentially polygonal cross-sectional shape, and a tangent placed at any point of the periphery of the sabot does not pass through the cross-sectional area of the sabot, thereby providing increased bending stiffness in the non-caliber-sized region of the sabot.

21 Claims, 11 Drawing Sheets

SEGMENTED, DISCARDABLE SABOT HAVING POLYGONAL CROSS-SECTION FOR SUB-CALIBER PROJECTILE

BACKGROUND OF THE INVENTION

The present invention relates to a segmented, discardable sabot for a slender, sub-caliber kinetic energy projectile.

A conventional dual-flange sabot (push-pull sabot) which includes a front caliber-sized guide flange and a rear caliber-sized pressure flange and which has a rotationally symmetrical cross section over its entire length is shown in FIG. 1. Dual-flange sabots having at least one longitudinal rib on the back of a sabot segment between the front guide flange and the rear pressure flange are disclosed, for example, in U.S. Pat. No. 4,326,464 and in German Patent No. 3,704,027. Further, conventional single-flange sabots (pull sabot) having a thrust and guide flange at the front and gas-permeable guide webs at the rear are disclosed, for example, in German Patent No.2,836,963 and corresponding U.S. Pat. No. 4,542,696, which is a continuation-in-part of U.S. Pat. No. 4,444,114. Here, too, the sabot segments are provided with a longitudinal rib in their central circumferential region in order to increase bending strength.

The advantage of a longitudinal rib structure is that it imparts a high bending stiffness to the reduced caliber intermediate region of the sabot between the front guide flange and the rear pressure flange for the process of releasing it from the projectile body as a result of the attacking air after it leaves the gun barrel. The disadvantage, however, is that, during firing and accelaration in the gun barrel and for the transfer of thrust from the sabot to the circumference of the projectile, longitudinal ribs always lie essentially outside the axial force lock and therefore, for the most part, constitute a "dead mass." Moreover the milling of a sabot segment with longitudinal ribs is cost intensive, particularly if the longitudinal ribs also have a diagonal or helical configuration as shown, for example in German Patent No. 3,704,027. Expensive, specifically shaped special tools are required to produce the longitudinal ribs and to work on the intermediate material.

It is characteristic for a conventional dual-flange sabot having a rotationally symmetrical cross section as shown in FIG. 1 that a rotationally symmetrical conical or cylindrical reduction in cross section is provided between the front flange and the rear pressure flange in front of the frontal rounding radius of the rear pressure flange. For reasons of fire resistance during passage through the tube, a significantly greater reduction in cross section would be possible in the region behind the front guide flange since hardly any thrust forces coming from the sabot are introduced at this point into the penetrator (projectile). A relatively large cross-sectional area in this region is required, however, to give the sabot segments the necessary bending stiffness during the discarding process after they leave the gun muzzle. Conventional dual-flange sabots thus have the disadvantage of being overly heavy particularly in the region behind the front guide flange.

SUMMARY OF THE INVENTION

It is an object of the present invention to provide a sabot of the above type in which the bending stiffness is increased simultaneously with a reduction in mass and wherein it is possible to produce the sabot in economic mass production series.

The above and other objects are accomplished by the present invention by the provision of a segmented, discardable sabot for a slender sub-caliber kinetic energy projectile which includes at least two sabot segments having adjacent plane parallel segment separating faces and presenting at least one caliber-sized gas sealing pressure flange member and a non-caliber sized partial region along the longitudinal extent of the sabot, wherein the overall cross section of the sabot, at least in the partial region, has an essentially polygonal cross-sectional shape where a tangent placed at any point of the periphery of the sabot does not pass through the cross-sectional area of the sabot, thereby providing increased bending stiffness in the non-calibersized region of the sabot.

The sabot according to the invention, in particular makes possible a cost-effective mass production involving simple processing steps. In conventional sabots having a longitudinal rib, a correspondingly applied tangent always passes through the cross-sectional area so that milling is possible only by means of correspondingly shaped special tools and necessitates a multitude of processing steps. In the polygonal cross-sectional shape of the sabot according to the present invention, the radial distance Ri in the cross-sectional area of the sabot from the central longitudinal axis A of the sabot to the outer periphery of the sabot is smallest at the segment separating faces and is greatest in the central peripheral region of a sabot segment between the two segment separating faces, so that it is possible, by redistributing the mass and cross-sectional area from regions near the sabot segment separating faces toward the direction of the central region between the sabot segment separating faces, to increase the bending stiffness to a value which is at least as great as the bending stiffness of a comparable sabot having a circular crosssectional area that is larger by about 25%.

In this way it is accomplished in an advantageous manner that the bending stiffness of the sabot having a polygonal or almost triangular cross-sectional shape is greater by a factor of at least 1.3 than the bending stiffness of a theoretical sabot having a circular cross-sectional area of the same size. The present invention makes possible a reduction of the mass of the sabot and a reduction of the sabot cross-sectional area to a degree necessary for firing through a tube while simultaneously providing a greater moment of bending resistance. Such a sabot is very economical to produce, particularly in mass production.

The invention will now be described in greater detail with reference to embodiments thereof that are illustrated in the drawing figures.

DETAILED DESCRIPTION OF THE PREFERRED EMBODIMENTS

Figure 1:
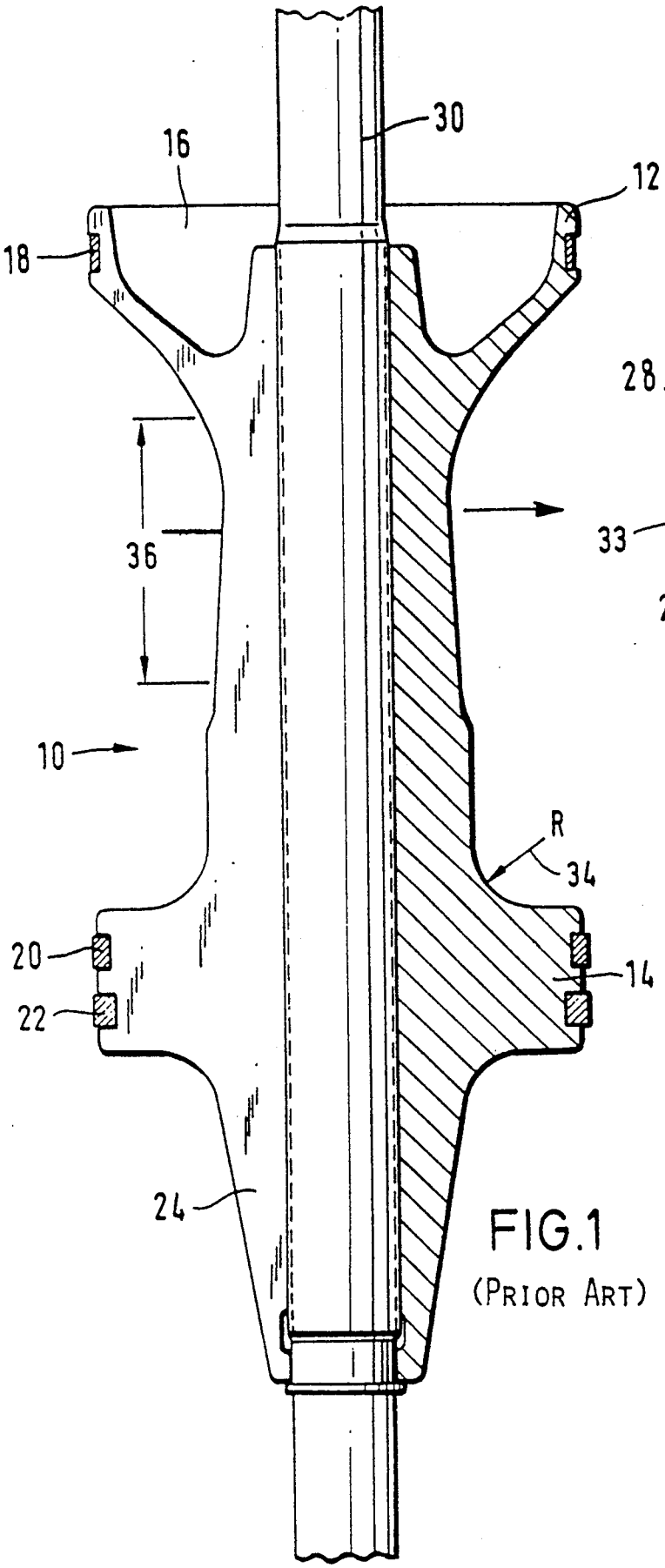
FIG.1 (PRIOR ART)
FIG. 1 is a longitudinal section of a conventional dual-flange sabot having a rotationally symmetrical cross section.

Referring to FIG. 1, there is shown a conventional dual-flange sabot 10 including a front guide flange 12 and a rear pressure flange 14, for example of a caliber of 120 mm, for a slender sub-caliber fin stabilized kinetic energy [KE] projectile 30 made of tungsten heavy metal. Between sabot 10 and KE projectile 30 there is provided a conventional form-locking zone (represented by a dashed line) which is equipped with threaded or annular grooves(not shown). The front guide flange 12 has an air pocket 16 at its frontal face as well as a circumferential guide band 18. Rear pressure flange 14 is likewise provided, in its caliber-sized circumferential region, with a guide band 20 and with a gas sealing band 22. Toward the rear of sabot 10, rear pressure flange 14 is followed by a conically tapering tail section 24.

Figure 1A:
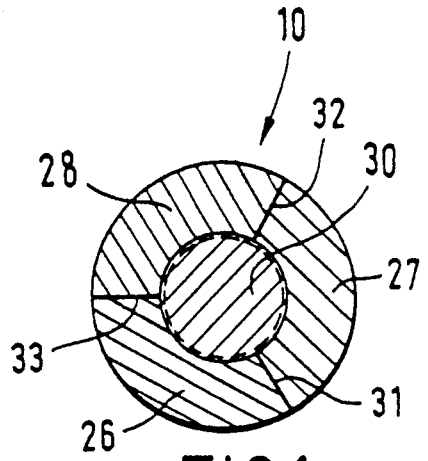
FIG.1a (PRIOR ART)
FIG. 1*a* shows a rotationally symmetrical cross section of the dual-flange sabot according FIG. 1.

Customarily, the rotationally symmetrical sabot 10 is composed of three sabot segments 26, 27 and 28 with planar segment separating faces 31, 32 and 33 therebetween (FIG. 1a).

Between front guide flange 12 and rear pressure flange 14, sabot 10 has a reduced diameter; that is, it has a lo cylindrical/conical reduction in cross section in front of the rounding radius 34 of rear pressure flange 14. Sabot 10 has a region 36 of partial longitudinal extent where it is not of caliber size and where it would be possible, for reasons of making the sabot resistant to the firing forces while passing through the tube, to further and more strongly reduce its cross sectional area up to front guide flange 12, since the conventional configuration of this region 36 provides for only slight stresses on the material. However, for reasons of sufficient bending stiffness during the discarding of the sabot and thus in order to avoid irregular and uncontrollable interfering influences on penetrator 30, sabot 10 must have a relatively large cross-sectional area in this region 36. Firing results indicate that rotationally symmetrical sabots in which the cross-sectional area in region 36 had been reduced further led to uncontrollable breakage of the sabot segments behind front guide flange 12 during the discarding process.

The object of the development of sabots for sub-caliber KE projectiles is to minimize the sabot mass in order to transfer maximum kinetic energy to the penetrator during passage through the tube. After leaving the tube, the sabot is discarded as a result of the aerodynamic forces acting on air pocket 16 of front guide flange 12. The smaller the sabot mass, and primarily the smaller the moment of inertia of the sabot segments about their rear roll-off edge, the faster the discarding process takes place and the lower is the loss of kinetic energy for the penetrator. This applies, in particular, if mass can be saved in the front portion of the sabot. This mass has the longest lever arm and thus contributes the greatest portion of the moment of inertia with respect to the rear roll-off edge (center of gravity of the sabot segments).

Figure 2:
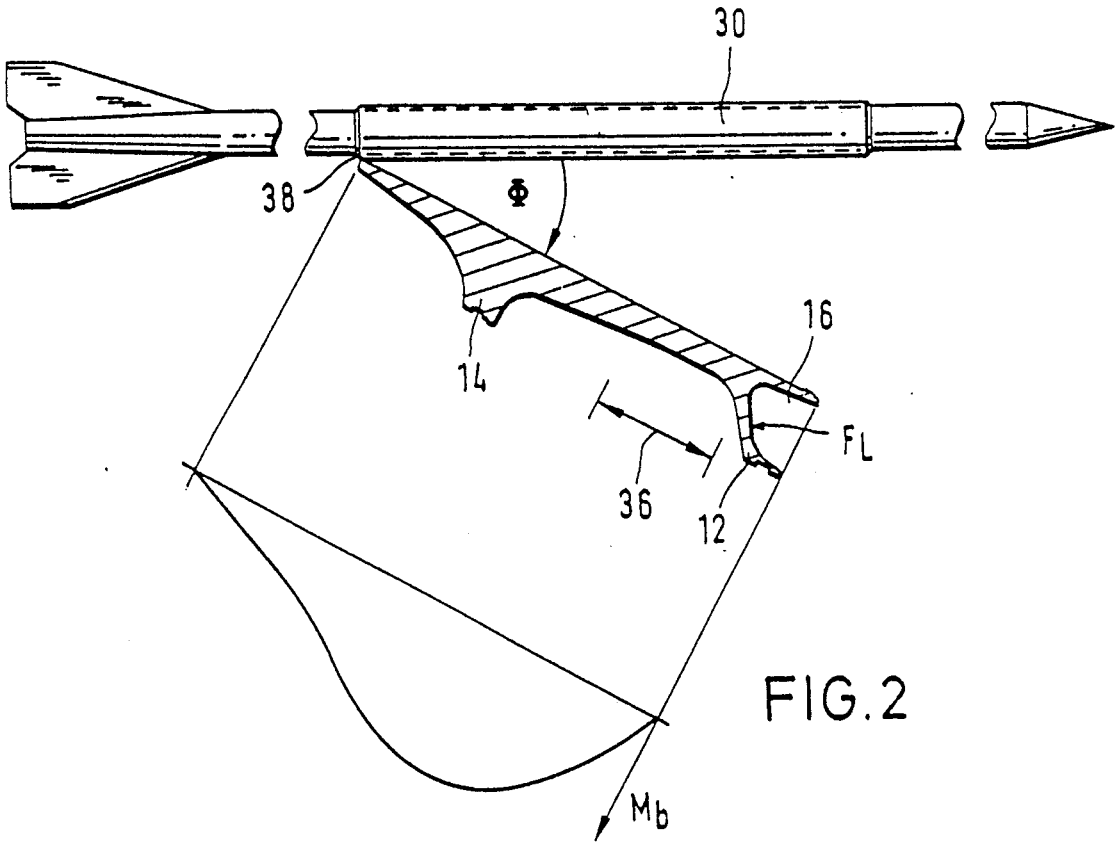
FIG. 2 is a schematic of a projectile and a sabot falling away and showing a qualitative curve of the bending moment in a sabot segment during the discarding process.

FIG. 2 shows the process of discarding of a sabot of a slender KE projectile after it leaves a tube muzzle. In an applied coordinate system in which the bending moment $M_b$ is plotted over the length of the sabot, the sabot performs a purely rotational movement about its rear roll-off edge 38 until it reaches an opening angle of $\Phi=20°$ to 30°. This rotational movement is created by the aerodynamic forces attacking the sabot, particularly in the region of the front air pocket. For small opening angles $\phi$, only the dynamic pressure in air pocket 16 becomes effective, here shown symbolically by the resulting air force $F_L$. This air force in conjunction with the inertia of a sabot segment result in the bending moment curve shown qualitatively in FIG. 2. The very steep rise of the bending moment $M_b$ in region 36 of the sabot directly behind front guide flange 12 is characteristic for this curve. Therefore, these cross-sectional areas of the sabot segments are highly in danger of breaking, and this has been demonstrated repeatedly in firing tests. In order to securely transfer the bending movement during discarding, a sabot segment must therefore have a crosssectional configuration in this region which has a sufficiently large surface moment and bending resistance moment.

Figure 3A:
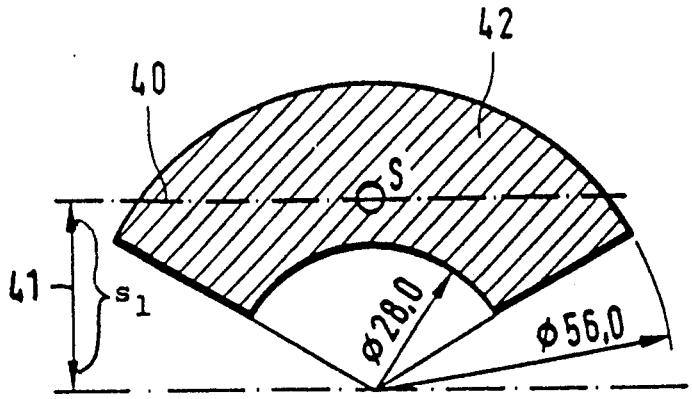
FIG.3a (PRIOR ART)
FIGS. 3*a* and 3*b* show two cross-sectional areas of conventional sabot segments.
Figure 3B:
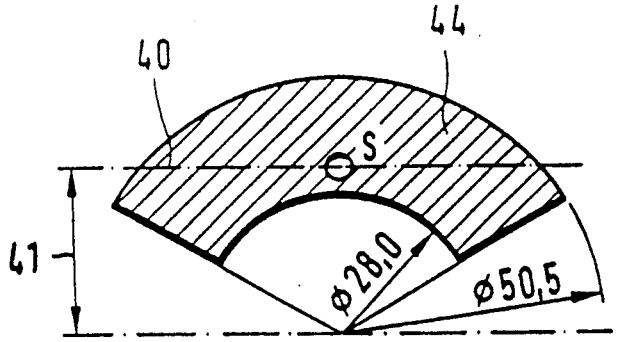
FIG.3b (PRIOR ART)
Figure 3C:
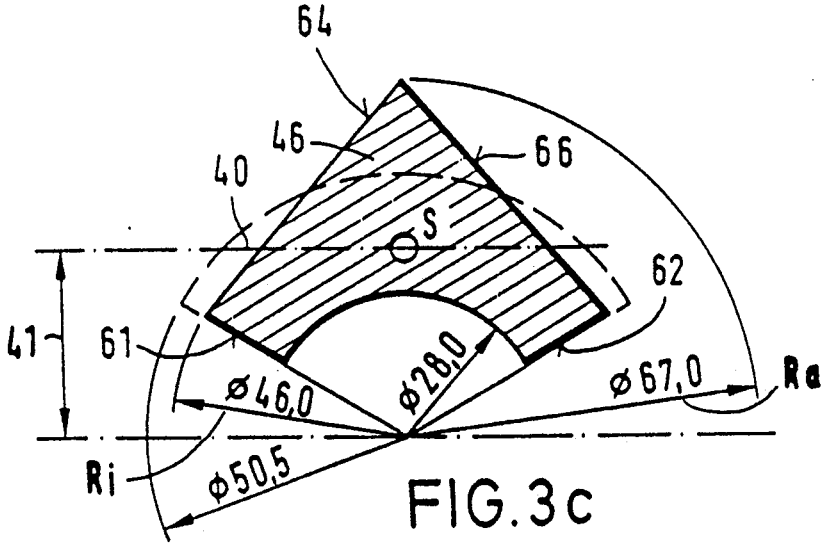
FIG. 3c shows the cross-sectional area of a sabot segment according to one embodiment of the invention.

FIGS. 3a, 3b and 3c show examples of various cross sections of sabot segments 42, 44 and 46. The inner diameter of all shown sabot segments 42, 44, 46 corresponds to the outer diameter of the projectile and takes a value of $\phi=28$ mm. For each one of these cross sections, the corresponding surface moment I and bending resistance moment $W_b$ are shown around the dash-dot line axis 40 through the center of gravity and are compared in the form of a tables at the end of this specification. The center of gravity is marked S in each case and has a distance $s_1$ 41 from the central longitudinal axis A. The surface moment I is a measure for the bending stiffness of the respective cross section of a sabot segment. The following linear relationship applies: the greater the surface moment I, the less the sabot segment is bent during discarding. The moment of bending resistance $W_b$ is a measure for the maximum stress on the material of a cross section under bending stress. Here again, a linear relationship applies: the greater the resistance moment $W_b$, the lower the maximum bending tension over the cross section for a given bending moment. As a result of the bending load on a sabot segment during its discarding, bending stresses occur in the cross-sectional direction above center of gravity axis 40 in the form of axial pressure stresses while in the lower cross-sectional region—when seen in the longitudinal direction of the sabot—axial tensile stresses are generated. The maximum bending stresses occur in the edge fibers of the cross section at a maximum distance from center of gravity axis 40. In the tables at the end of this specification, the superscript indices "o" and "u" relate to the stated bending resistance moments $W_b$, that is, to the upper and lower edge fiber of the respective sabot cross section. Consequently, the upper resistance moment $W_b^o$ is a measure for the maximum axial pressure stress in the shoulder of the sabot segment cross section; while the lower resistance moment $W_b^u$ is a measure for the maximum tensile stress occurring in the form-locking region of the sabot cross section at the two segment separating faces. If the lower bending resistance moment $W_b^u$ is too low, the flexural tensile stress during discarding of the sabot initiates a crack in the root of a thread groove leading to breakage of the sabot segment in region 36 behind front guide flange 12. If, however, the upper bending resistance moment is too small, plastification will produce merely a repositioning of the pressure stress peaks in the shoulder of the respective sabot segment cross section; but there will be no break.

Figure 4A:
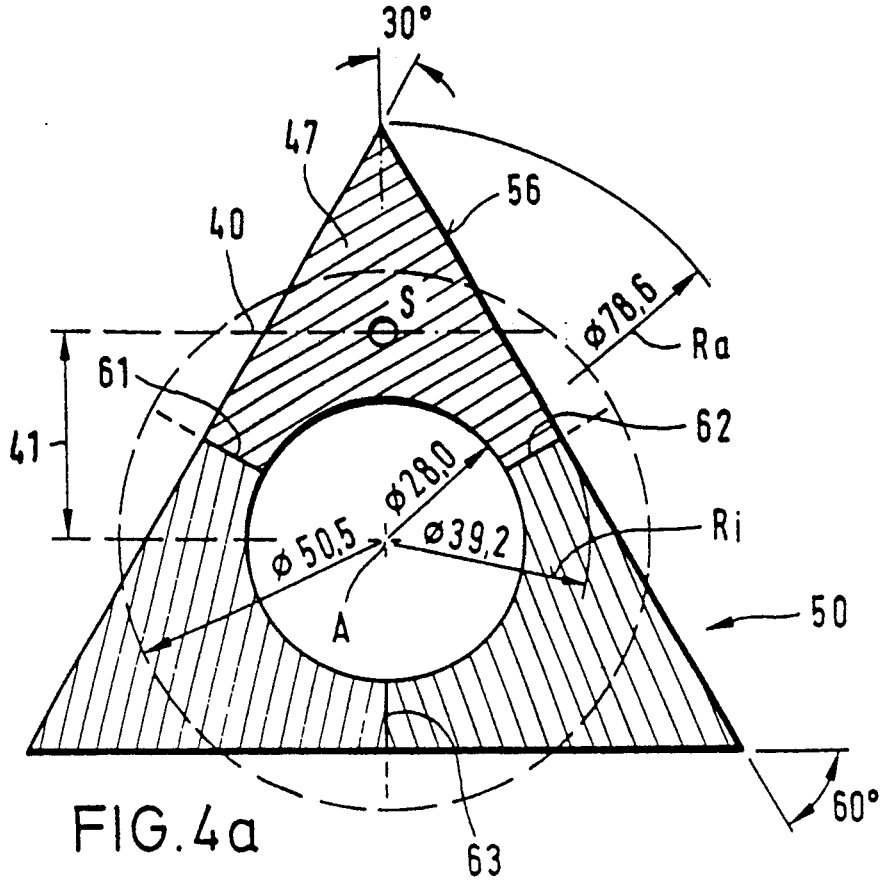
FIGS. 4a and 4b show further cross-sectional shapes of sabots according to the invention.
Figure 4B:
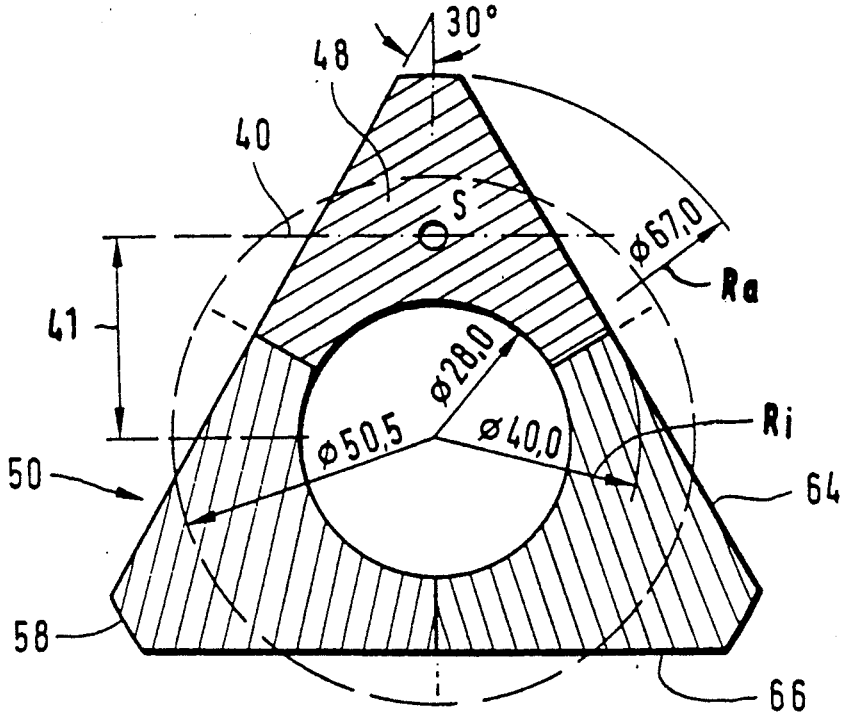

In the exemplary calculations appearing in the tables at the end of the specification, cross section 1 represents the rotationally symmetrical sabot segment 42 of FIG. 3*a*, cross section 2 represents the smaller rotationally symmetrical sabot segment 44 of FIG. 3*b*, cross section 3 represents the first sabot segment 46 according to the invention shown in FIG. 3*c*, cross section 4 represents a further inventive sabot segment 47 in the overall surface area illustration of FIG. 4*a* and cross section 5 represents a modified inventive sabot segment 48 in the overall surface area illustration of FIG. 4*b*.

Cross section 1 in FIG. 3*a* shows the cross-sectional area of a sabot segment in region 36 of the prior art sabot 10 of the most modern design as shown in FIG. 1 with an outer diameter $\phi=56$ mm. This cross section 1 has sufficiently large bending resistance moments to securely absorb the bending moment during discarding of the sabot. In order to transfer the axial forces occurring during passage through the tube upon firing so as to accelerate the penetrator, it would merely be necessary to reduce the area of circular cross section 2 of FIG. 3*b* having an outer diameter of $\phi=50.5$ mm by about 25%. Although such a large reduction in surface area would result in enormous savings in weight in the sabot, the bending resistance moments of the rotationally symmetrical cross section 2 (FIG. 3*b*) are much too small and lead to the uncontrollable breakage of sabot segments 44 during the discarding process, as unequivocally demonstrated by firing test results.

The solution according to the present invention is based on the principle of employing preferably in the region 36 of a sabot segment 46 where it is endangered by bending and breakage, novel cross sections of comparatively smaller surface area with sufficiently large surface moment and bending resistance moment.

Cross-sections 3, 4 and 5 in FIGS. 3*c*, 4*a* and 4*b* show sabot segments according to the present invention. They are no longer rotationally symmetrical and, compared to the conventional circular cross sections 1 and 2 of FIGS. 3*a* and 3*b*, are distinguished by a compact, larger profile height and in each case by two planar peripheral faces 64 and 66. A tangent 54 laid to any point of the sabot periphery 56 no longer passes through the cross-sectional area 50 of the sabot (see FIG. 6). All sabot segments according to the present invention mentioned here have a cross-sectional area that has been reduced by about 25% with respect to the comparison circular cross section 1 of FIG. 3*a*. The outer diameter $\phi=50.5$ mm having the same reduced cross-sectional area according FIG. 3*b* is also indicated in the FIGS. 3*c*, 4*a* and 4*b*. In the polygonal cross-sectional shape of the sabot according to the present invention, the smallest radial distance Ri from the central longitudinal axis A to the outer periphery of the sabot is at the segment separating faces 61, 62, 63 and the largest radial distance Ra is in the center peripheral region of a segment between the two segment separating faces (e.g. see FIG. 4*a*). In the figures values for these radial distances $R_i$ and $R_a$ are given as diameters $\phi$ in mm for corresponding circles. The cross-sectional shape of the sabot according to the invention effectively redistributes mass and cross-sectional area, from regions near segment separating faces of a sabot segment having the same cross-sectional area of a sabot with a circular cross section, toward a central peripheral region between the segment separating faces resulting in an increase of bending stiffness to a value which is at least as high as the bending stiffness of a comparison sabot having a circular cross-sectional area that is larger by 25%. Stated another way, the sabot according to the invention has a bending stiffness which is greater by a factor of 1.3 than the bending stiffness of a theoretical sabot having a circular cross-sectional area if the same size.

Sabots according to the present invention as shown in FIGS. 5, 6, 7, 9, 10 and 11 have already been manufactured in a caliber of 120 mm and have been fired successfully. Due to the inventive triangular or polygonal cross-sectional configuration of the sabot segments, such a sabot is lighter in weight by about 100 g and by about 6 % than a comparable modern sabot of conventional construction which has a rotationally symmetrical cross section.

For example, the sabot segment of FIG. 3*c* having cross section 3 is 7.4 % more resistant to bending than comparison cross section 1 (FIG. 3*a*) and, even in the crack endangered tensile stress subjected thread region, has a bending resistance moment that is greater by 5.2%.

Even more favorable are conditions for the sabot segment cross section shown as cross section 4 in FIG. 4*a*. This profile has 65.2% more bending resistance than comparison cross section I (FIG. 3*a*). Due to the lower bending resistance moment being greater by 37.7%, the originally crack endangered thread region of this profile has become completely uncritical.

Figure 6:
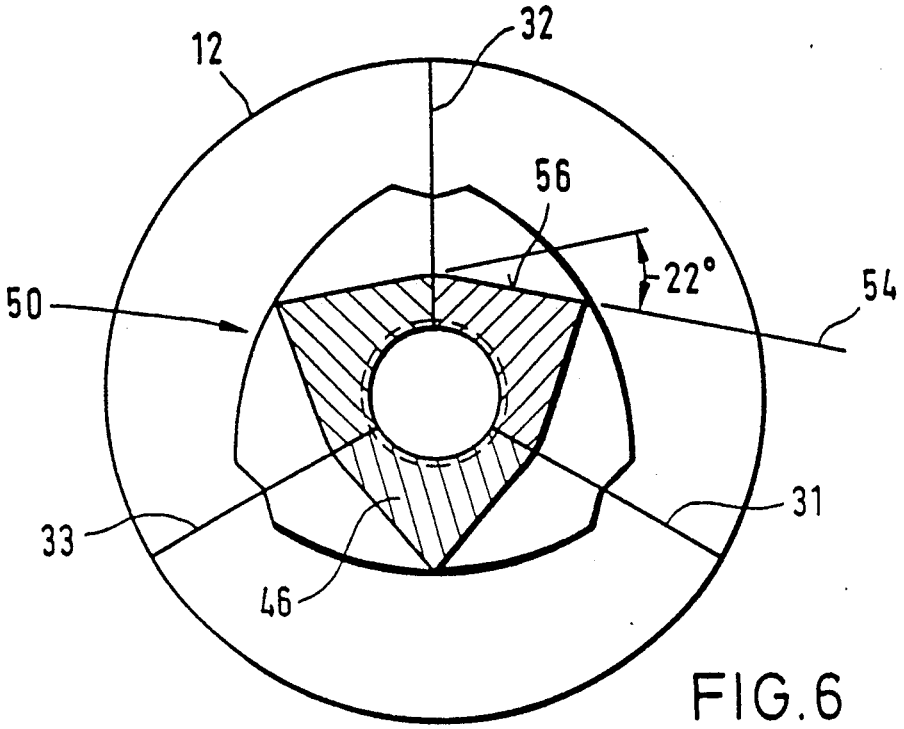
FIGS. 6 and 7 are cross-sectional views of the sabot according to the invention seen along the sectional lines VI—VI and VII—VII of FIG. 5.
Figure 7:
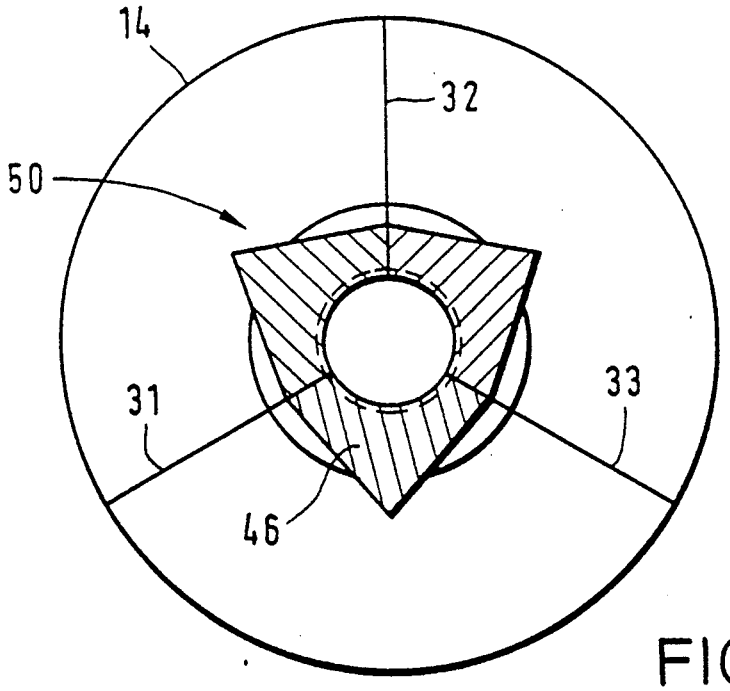

From a manufacturing point of view, the sabot segments according to cross section 4 (FIG. 4*a*) and cross section 5 (FIG. 4*b*) are distinguished in that their outer profile edges are inclined by 30° relative to the center line of the cross section; or in other words, when seen in cross section, the planar peripheral faces of each sabot segment 47 enclose an angle of precisely 60° in the back region between segment separating faces 61 and 62 and thus are oriented at a right angle to the respectively adjacent segment separating face 61, 62. For the manufacturing process this means that, in the region of the inventive cross-sectional shape, the entire sabot need be machined only in three milling planes if two adjacent, planar peripheral faces 64, 66 of two adjacent sabot segments 47 change linearly and in one plane into one another (FIG. 4*a*) in the peripheral direction at the segment separating line 62 lying therebetween. In cross section 3 (FIG. 3*c*), there would be six milling planes for the case that two adjacent planar peripheral faces 64, 66 of two adjacent sabot segments change into one another or border on one another in the peripheral direction along a segment separating line 32 lying between them under an angle of less than 30° as shown in FIG. 6. Therefore, for the process of milling the planar peripheral faces, simple, inexpensive, cylindrical roller cutters can be employed.

The geometric particularity of the sabot segment profile of cross section 5 shown in FIG. 4*b* is that, in contrast to cross sections 3 and 4 (FIGS. 3*c* and 4*a*), the flanks of the profile and the planar peripheral faces no longer intersect in one point. The shoulder of this cross-sectional profile is thus no longer just a single point but a circular arc 58. The advantage of this sabot segment construction compared to cross section 4 (FIG. 4*a*) is primarily the noticeably improved upper bending resistance moment which is here only 0.8% smaller than that of comparison cross section 1 of FIG. 3*a*.

Figure 8:
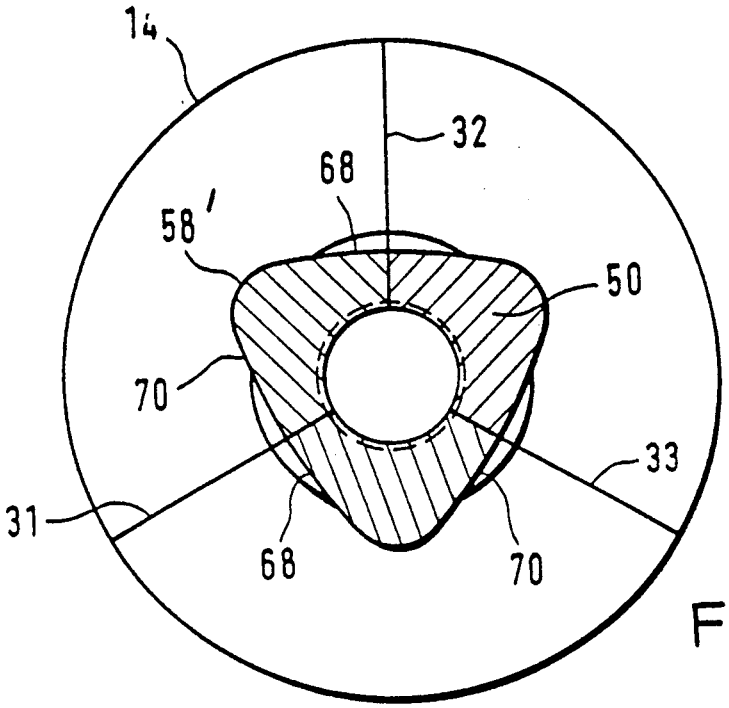
FIG. 8 shows a further embodiment of a sabot cross section according to the invention.

Another triangular or polygonal sabot cross section that is favorable for manufacture is shown in FIG. 8. Here, instead of the planar peripheral faces, slightly outwardly arched or curved peripheral faces 68, 70 are provided while in the back region between these peripheral faces there is disposed a greatly curved or rounded peripheral region 58'. The advantage of this rounded embodiment is that it is possible to manufacture this sabot as an economical "turned component" on an eccentric lathe.

As already described, the solution according to the invention is based on the principle of employing, particularly in the bending endangered sabot segment region behind the front guide flange of a sabot, non-rotationally symmetrical cross sections with a smaller surface area but a greater surface moment and bending resistance moment compared to conventional rotationally symmetrical cross sections.

In principle, the inventive triangular cross-sectional configuration of the sabot may be employed in all non-caliber-sized regions, particularly in connection with sabots having a large longitudinal extent, such as, for example, sabots for two tandem projectiles arranged one behind the other, with the non-rotationally symmetrical cross section possibly also being provided in the elongate, conically tapered tail section behind the pressure flange so as to also increase the bending stiffness there.

Figures 5, 5A:
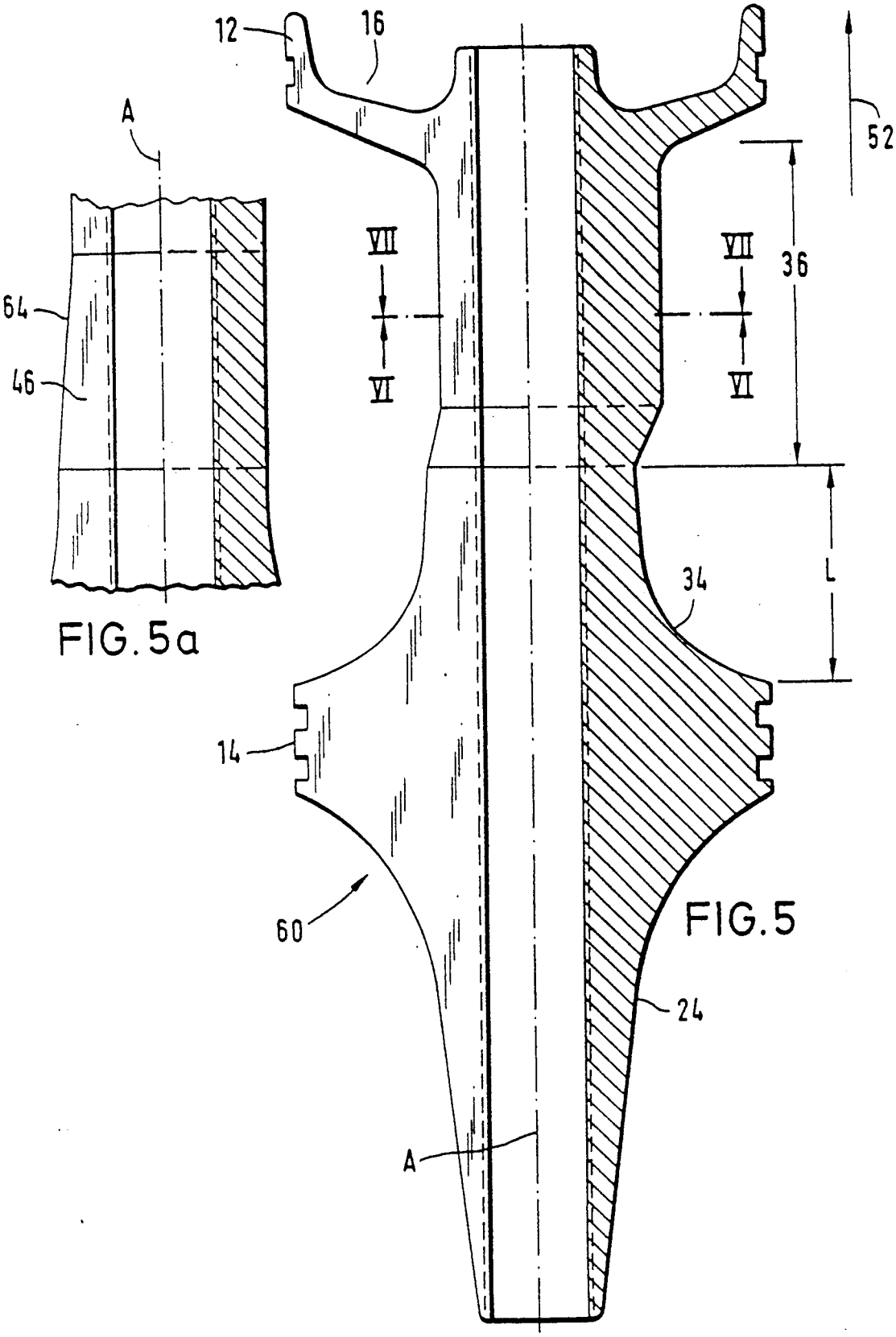
FIGS. 5 is a longitudinal sectional view of a sabot according to another embodiment of the invention.
FIG. 5a is a partial longitudinal sectional view of a sabot segment which is a variation of FIG. 5.

However, for reasons of firing resistance during the passage through the tube, it is not appropriate, in connection with the sabot according to the invention as shown in FIG. 5, to dispose the segment profiles provided according to the invention over the entire length region of the sabot between the front guide flange 12 and the rear pressure flange 14. The rotational symmetry in the region of the rounding radius 34 in front of pressure flange 14 should be retained in any case. The following should apply for the length L defined in FIG. 5 as the distance between pressure flange 14 and the beginning of the non-rotationally symmetrical cross-sectional profile in the sense of the present invention: $L \geqq D/5$ (where D=caliber diameter). Arrow 52 indicates the direction in which the sabot arrangement is fired.

The sabot configurations according to the invention shown in FIGS. 5, 9, 10 and 11 have a constant cross-sectional area in the entire non-rotationally symmetrical sabot region. Moreover, the polygonal cross-sectional shape according to the invention is provided only o less than an 80% portion, preferably about 60%, of the longitudinal extent between front guide flange 12 and rear pressure flange 14. The sabot is thus preferably rotational symmetrical in a sub-region 34 immediately in front of rear pressure flange 14 and in a sub-region 34' immediately behind front guide flange 12 when the sabot is viewed in the direction from the front guide flange toward the rear pressure flange (see FIG. 10 and 11).

Since during passage through the tube upon firing, the axial forces to be transmitted by the sabot segment in order to accelerate and support the penetrator steadily increase with increasing distance from the front guide flange 12 toward the rear, it is certainly appropriate to configure the region of the sabot which is in danger of bending with an inventive profile as shown in FIG. 5*a* whose cross-sectional area of the planar peripherical face 64 steadily increases from the front guide flange 12 in the direction toward the rear pressure flange 14. The planar peripheral faces 64, 66 of the sabot segments may here extend at a slight angle relative to longitudinal axis A in which case the rounded intermediate region 58 between two planar peripheral faces if it is provided, would become correspondingly wider from the front toward the rear.

Figure 9:
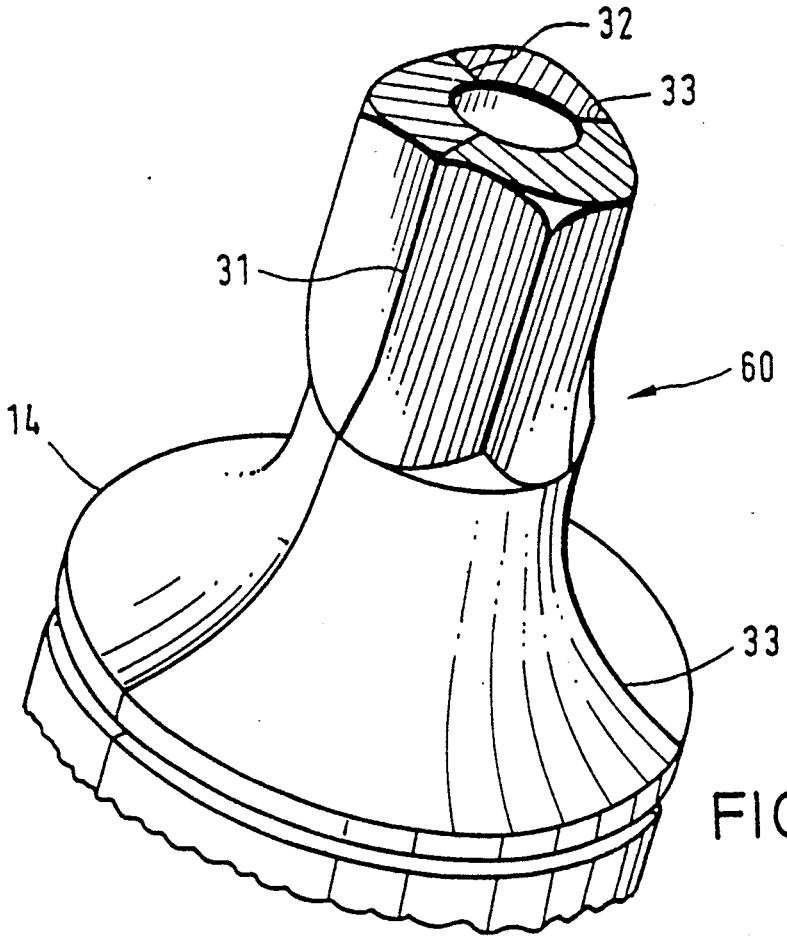
FIG. 9 is a perspective view of a sabot according to an embodiment of the invention.
Figure 10:
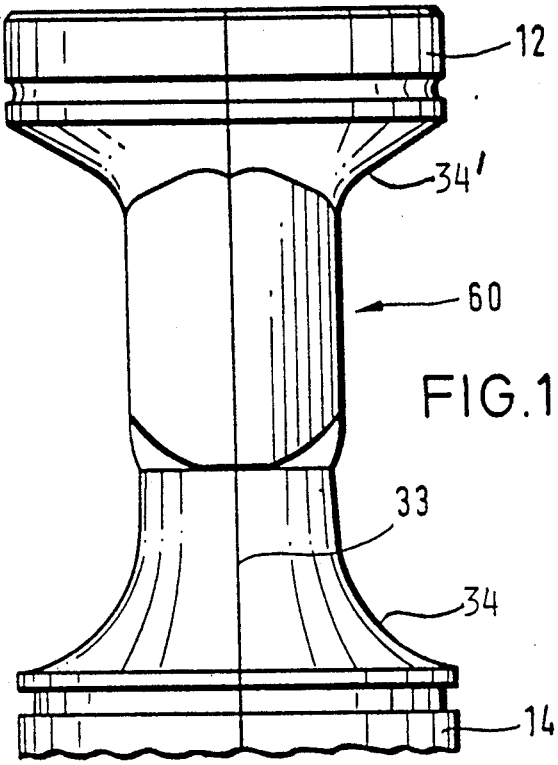
FIGS. 10 and 11 are side views of parts of a sabot according to embodiments of the invention.
Figure 11:
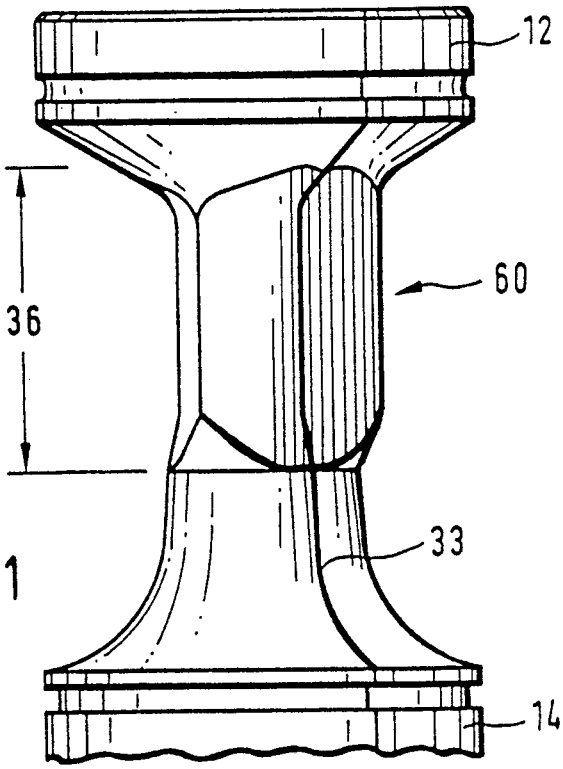

FIGS. 9, 10 and 11 are partial sectional views, seen in perspective and from the side, respectively, of a sabot 60 according to the invention which has a sabot segment cross-sectional area (cross section 3) as shown in FIG. 3*c*.

Thus, as already described, the present invention permits a considerable reduction in mass (dead weight percentage) in a sabot while simultaneously considerably increasing its bending stiffness. Simple and cost effective mass production becomes possible. The present invention is applicable for all possible weapons of small or large caliber fired through rifled or smooth tubes, allowing the firing of sabot projectiles. The profiles according to the invention can be employed not only in connection with dual-flange sabots but also in connection with single-flange sabots.

Figure 12:
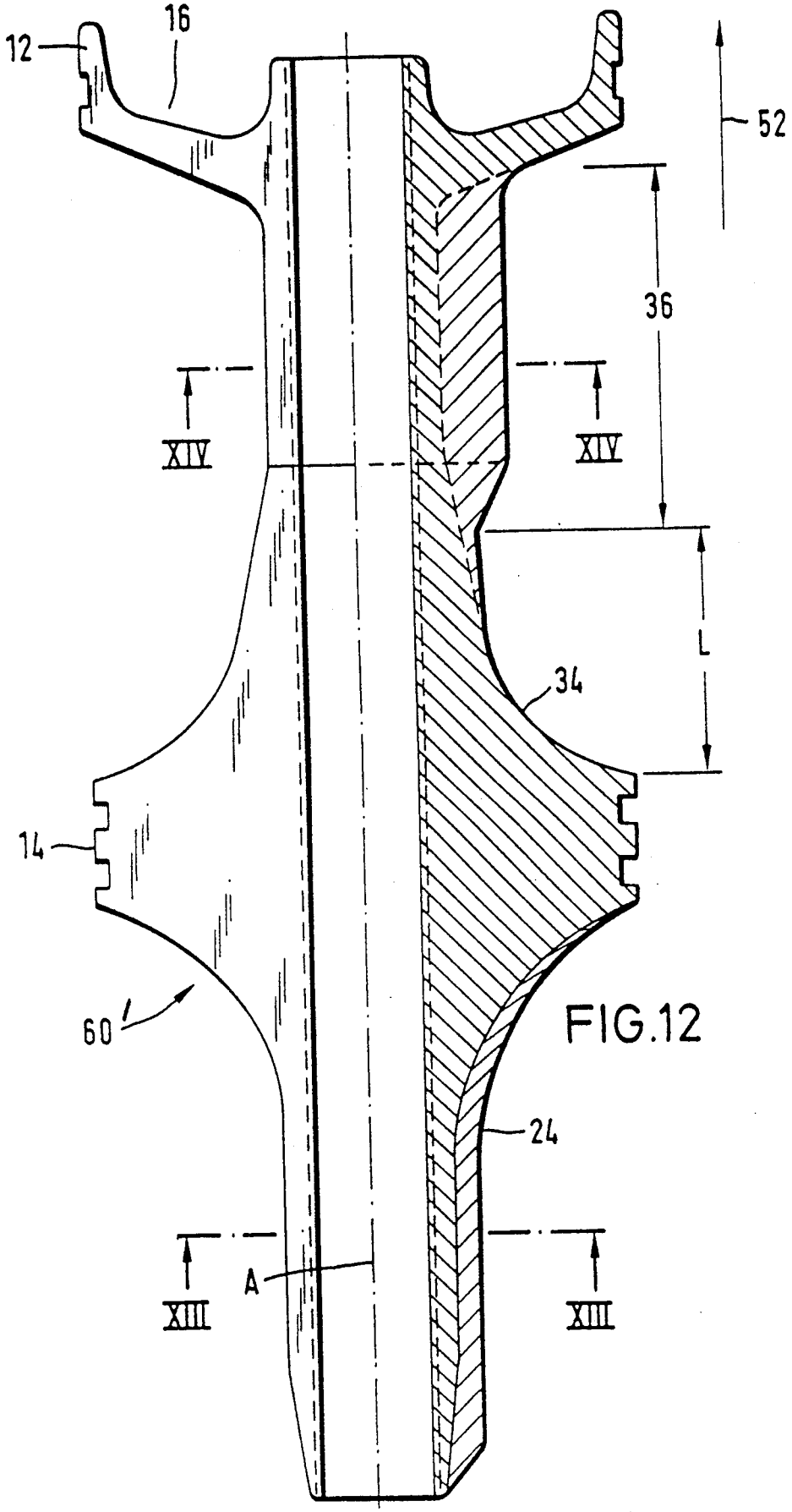
FIG. 12 is a longitudinal sectional view of a further embodiment of a sabot according to the invention.

FIG. 12 shows another embodiment of a sabot according to the invention in which a sabot 60' having an essentially triangular cross-sectional area is formed not only in the front length region 36 between front guide flange 12 and rear pressure flange 14, but also in the rear tail section 24 behind pressure flange 14. The arrangement of a polygonal cross-sectional shape 72 on tail section 24 of sabot 60' results in an increase in bending stiffness in this region as well without additional increase in mass.

Figure 13:
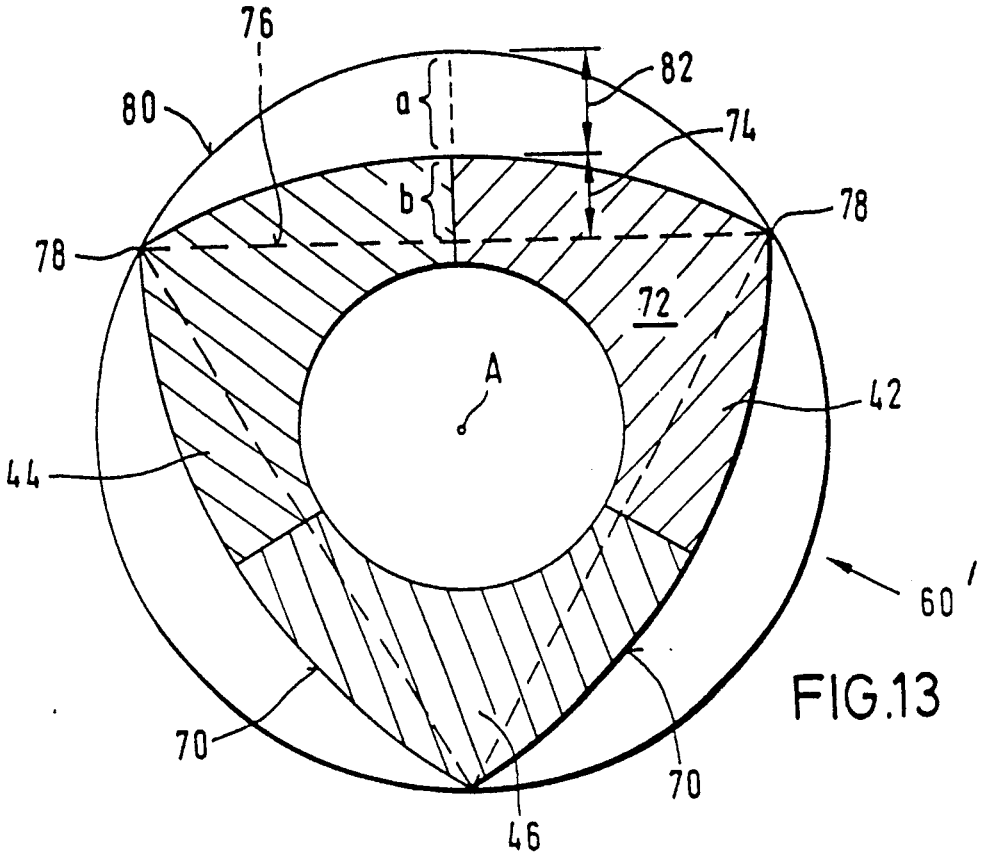
FIGS. 13 and 14 are cross-sectional views as seen along sectional lines XIII—XIII and XIV—XIV in FIG. 12.

FIG. 13 is a cross section through the region in tail section 24 behind pressure flange 14 in sabot 60' shown in FIG. 12 wherein the outer surface 70 of polygonal cross-sectional shape 7 is curved slightly convexly outwardly. Reference numeral 80 identifies the original circumferential face, where 82 is the maximum distance a between curved outer face 70 of cross-sectional shape 72, and 74 is the maximum distance b of the curved outer face 70 relative to a straight line 76 connecting corner points 78 which terminate each curved outer face 70. The principle of the smallest possible curvature for the outer face 70 is expressed geometrically in that $b \leqq a$.

Figure 14:
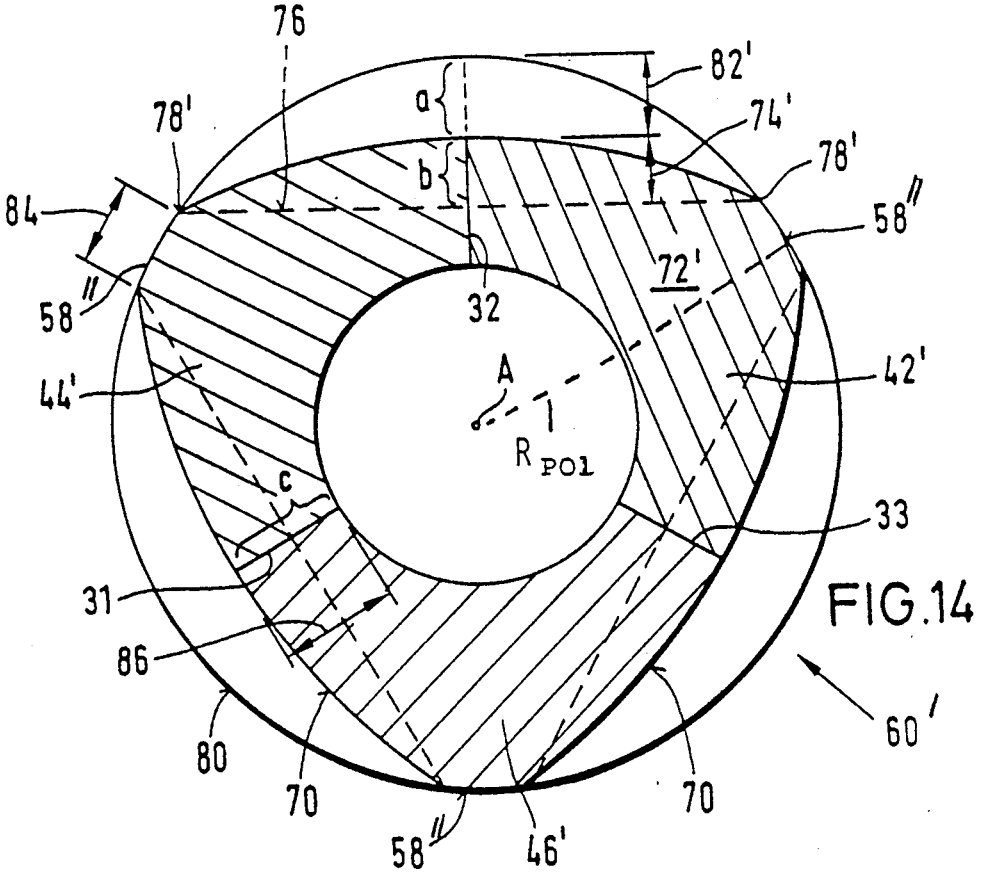

FIG. 14 shows a cross section through region 36 between front guide flange 12 and rear pressure flange 14 of sabot 60' shown in FIG. 12. The two embodiment shown in FIGS. 13 and 14 are interchangeable. That is, the cross section shown in FIG. 13 can be applied to region 36 of sabot 60' and the cross section shown in FIG. 14 can accordingly be disposed on tail section 24 behind pressure flange 14. Additionally it is possible for both cross-sectional shapes 72 and 72' shown in FIGS. 13 and 14 to change into one another.

Referring to FIG. 14, reference numeral 72' identifies the polygonal cross-sectional shape which here has been modified to the extent that the adjacent, slightly curved exterior faces 70 are not directly adjacent one another but are separated from one another by a narrow arcuate outer face 58''. The center point of this arcuate exterior face 58'', which has the radius $R_{pol}$, lies in the center A of the overall cross-sectional area 72' of sabot 60' which point corresponds to the point of intersection of the three segment separating faces 31, 32 and 33. In FIG. 14, reference character c identifies the length 86 of segment separating faces 31, 32 and 33. The circumferential length 84 of the arcuate exterior face 58'' is here shorter than length c, 86 of segment separating faces 31, 32, 33. As already shown in FIG. 13, the curvature of its exterior face 70 is again as slight as possible. Reference character a, again identify the maximum distance 82' between the curved exterior face 70 of cross-sectional shape 72' and circumference 80. In this illustration, the straight line 76 connects terminating corner points 78'. Compared to FIG. 13, which has three corner points 78, this cross section results in six corner points 78' since the curved exterior faces 70 are not directly adjacent to one another but are separated from one another by arc segments 58''. Each curved exterior face 70 has two corner points 78' in common with adjacent arc segments 58''. The latter are connected together by a straight line 76. The maximum distance between this straight line 76 and the curved exterior face 70 is identified by b, 74'. The slightest possible curvature is here again determined geometrically, as in FIG. 13, in that $b \leqq a$.

Figure 15:
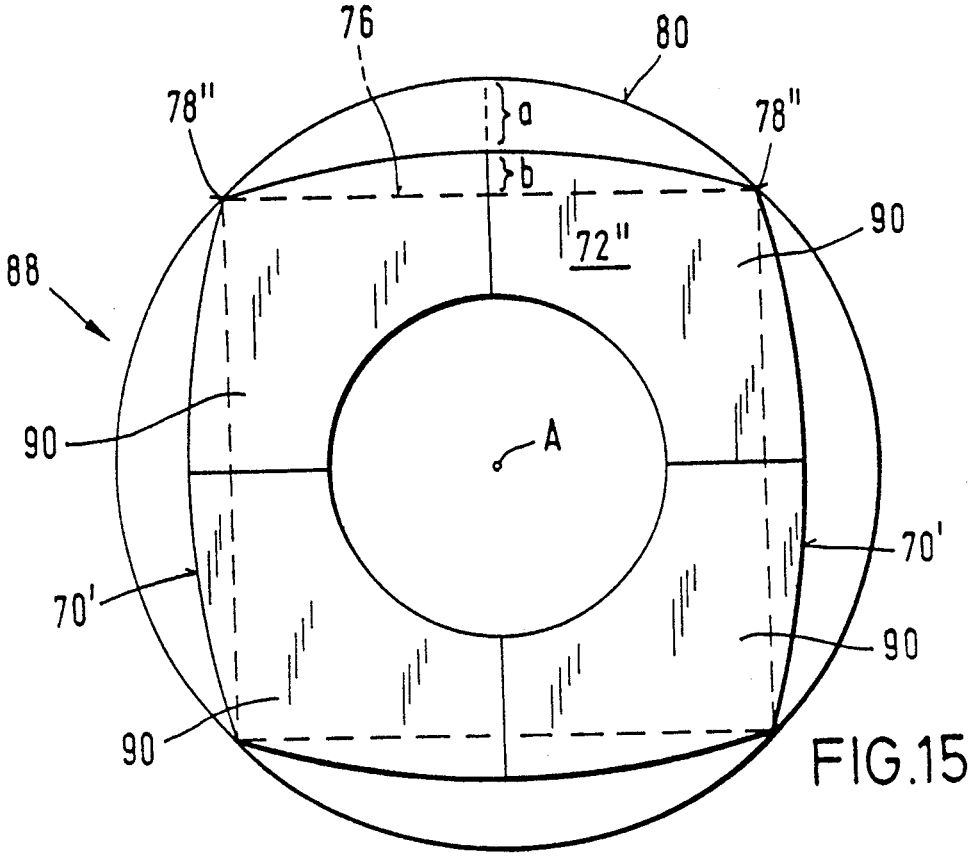
FIGS. 15 and 16 are cross-sectional views of four-segment sabots according to further embodiments of the invention.

FIG. 15 is a cross-sectional view of a sabot 88 which is divided into four sabot segments 90. The essentially square cross-sectional shape can also be applied with the aid of simple turning processes to a partial region of the longitudinal extent of a four-segment sabot 88.

The four exterior faces 70' of this square cross-sectional shape are curved outwardly in a slightly convex manner. As described in connection with FIGS. 13 and 14, here again the arc of the curved exterior faces 70' is as slight as possible and is again determined geometrically by the fact that the maximum distance b between the straight line 76 connecting corner points 78'' and the curved exterior face 70' is equal to or less than the maximum distance a of the curved exterior face 70' from the original circular circumferential face 80.

The four segment separating faces of sabot segments 90 are arranged such that the radial distance from central longitudinal axis A to the curved outer face 70' is smallest at the segment separating faces.

Figure 16:
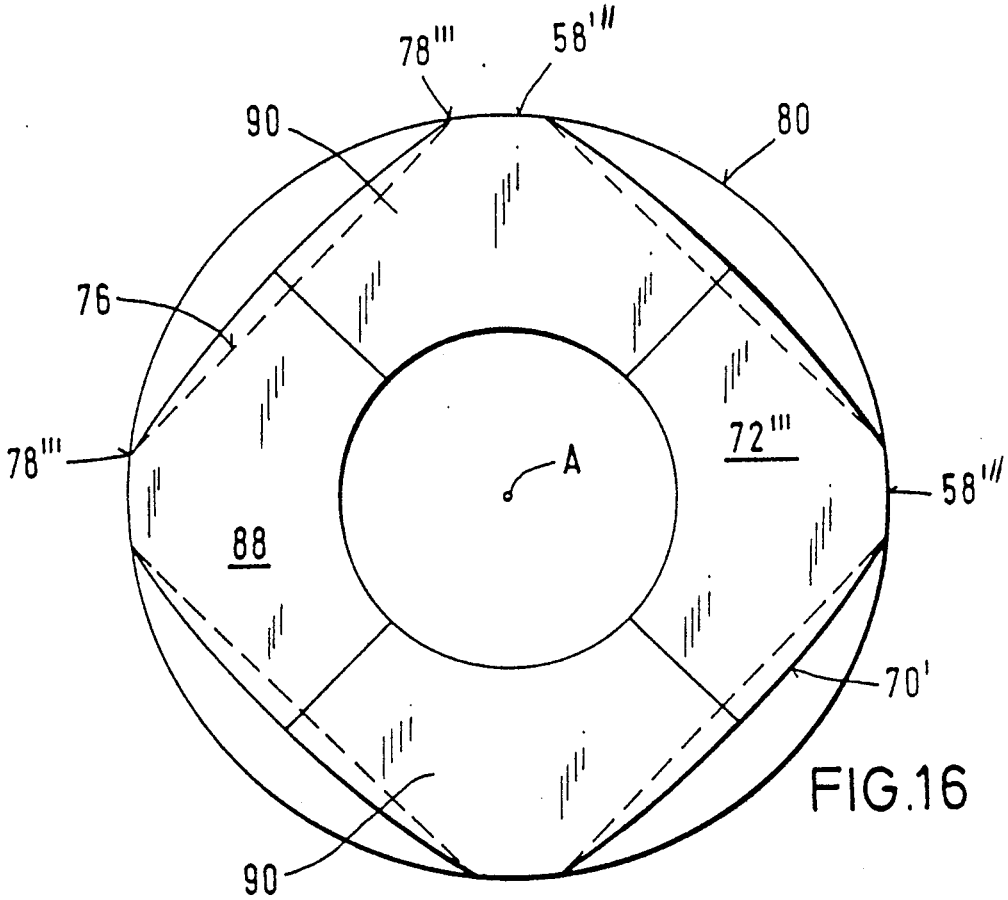

FIG. 16 modifies FIG. 15 to the extent that each sabot segment 90, when seen in cross section, has a small arcuate exterior face 58''' between the two adjacent slightly curved exterior faces 70'. The center point of this arcuate exterior face 58''' at radius $R_{qua}$ lies in the center A of the overall cross-sectional area of sabot 88. This center point again corresponds to the center point of the segment separating faces. This embodiment in particular has a very slight curvature on exterior face 70'.

The cross sections shown in FIGS. 15 and 16 can be changed from one to the other. The distance b in FIG. 15 is predetermined by the lathe employed. The curvature of exterior faces 70' may be varied by means of the eccentricity of the lathe.

TABLES

Definitions:

$$f_i = \frac{A_i - A_1}{A_1}; \quad t_i = \frac{I_i - I_1}{I_1}; \quad q_i = \frac{W_{b,i} - W_{b,1}}{W_{b,1}};$$

$i = 2, 3, 4, 5$ where i is the cross section number 2, 3, 4, 5 corresponding to FIGS. 3b, 3c, 4a, and 4b, respectively and $f_i$ is the percentage change in cross-section $A_i$ $s_i$ corresponds to the distance s of the center of gravity S to the central longitudinal axis; $t_i$ is the percentage surface moment $I_i$; and $q_i$ is the percentage in bending resistance moment $W_b$

| | | | | | | |
|---|---|---|---|---|---|---|
| Cross Section 1 (FIG. 3a) | | | | | | |
| $s_1$ | = | 18.0 mm | | | | |
| $A_1$ | = | 616 $mm^2$ | | | | |
| $I_1$ | = | 13,500 $mm^4$ | | | | |
| $W^o_{b,1}$ | = | 1,352 $mm^3$ | | | | |
| $W^u_{b,1}$ | = | 1,227 $mm^3$ | | | | |
| Cross Section 2 (FIG. 3b) | | | | | | |
| $s_2$ | = | 16.7 mm | | | | |
| $A_2$ | = | 462 $mm^2$; | $f_2$ | = | −25.0% | |
| $I_2$ | = | 7,600 $mm^4$; | $t_2$ | = | −43.7% | |
| $W^o_{b,2}$ | = | 891 $mm^3$; | $q^o_2$ | = | −34.1% | |
| $W^u_{b,2}$ | = | 790 $mm^3$; | $q^u_2$ | = | −35.6% | |
| Cross Section 3 (FIG. 3c) | | | | | | |
| $s_3$ | = | 18.2 mm | | | | |
| $A_3$ | = | 462 $mm^2$; | $f_3$ | = | −25.0% | |
| $I_3$ | = | 14,500 $mm^4$; | $t_3$ | = | +7.4% | |
| $W^o_{b,3}$ | = | 950 $mm^3$; | $q^o_3$ | = | −29.7% | |
| $W^u_{b,3}$ | = | 1,291 $mm^3$; | $q^u_3$ | = | +5.2% | |
| Cross Section 4 (FIG. 4a) | | | | | | |
| $s_4$ | = | 20.2 mm | | | | |
| $A_4$ | = | 462 $mm^2$; | $f_4$ | = | −25.0% | |
| $I_4$ | = | 22,300 $mm^4$; | $t_4$ | = | +65.2% | |
| $W^o_{b,4}$ | = | 1,170 $mm^3$; | $q^o_4$ | = | −13.5% | |
| $W^u_{b,4}$ | = | 1,689 $mm^3$; | $q^u_4$ | = | +37.7% | |
| Cross Section 5 (FIG. 4b) | | | | | | |
| $s_5$ | = | 19.6 mm | | | | |
| $A_5$ | = | 462 $mm^2$; | $f_5$ | = | −25.0% | |
| $I_5$ | = | 18,600 $mm^4$; | $t_5$ | = | +37.8% | |
| $W^o_{b,5}$ | = | 1,341 $mm^3$; | $q^o_5$ | = | −0.8% | |
| $W^u_{b,5}$ | = | 1,473 $mm^3$; | $q^u_5$ | = | +20.0% | |

Obviously, numerous and additional modifications and variations of the present invention are possible in light of the above teachings. It is therefore to be understood that within the scope of the appended claims, the invention may be practiced otherwise than as specifically claimed.

What is claim is:

1. A segmented, discardable sabot for a slender subcaliber kinetic energy projectile, comprising:

at least two sabot segments having adjacent plane parallel segment separating faces and presenting at least one caliber-sized gas sealing pressure flange member and a non-caliber sized partial region along the longitudinal extent of said sabot, wherein the overall cross section of said sabot, at least in said partial region, has an essentially polygonal cross-sectional shape, and a tangent placed at any point of the periphery of said sabot does not pass through the cross-sectional area of said sabot, thereby providing increased bending stiffness in the non-caliber-sized region of said sabot.

2. A sabot as defined in claim 1, wherein said essentially polygonal cross-sectional shape is an essentially triangular cross-sectional shape.

3. A sabot as defined in claim 2, wherein said sabot has a central longitudinal axis and an outer periphery, and in said partial region of essentially triangular cross sectional shape the radial distance from the central longitudinal axis to the outer periphery of the sabot is smallest at said segment separating face and the radial distance in the center peripheral region of a segment is greatest between the two separating faces of a segment, wherein the essentially triangular cross section of said sabot effectively redistributes mass and cross-sectional area, from regions near segment separating faces of a sabot segment having the same cross-sectional area of a sabot with a circular cross section, toward a central peripheral region between said segment separating faces resulting in a increase of bending stiffness to a value which is at least as high as the bending stiffness of a comparison sabot having a circular cross-sectional area that is larger by 25%.

4. A sabot as defined in claim 1, wherein said sabot has a bending stiffness which is greater by a factor of 1.3 than the bending stiffness of a theoretical sabot having a circular cross-sectional area of the same size.

5. A sabot as defined in claim 1, wherein each sabot segment has at least two planar peripheral faces.

6. A sabot as defined in claim 5, wherein two adjacent planar peripheral faces of two adjacent sabot segments change into one another in the peripheral direction at adjacent segment separating faces under an angle of less than 30°.

7. A sabot as defined in claim 5, wherein two adjacent planar peripheral faces of two adjacent sabot segments change into one another in the peripheral direction at adjacent segment separating faces in a single plane.

8. A sabot as defined in one of the preceding claim 5, wherein, when seen in cross section, the planar peripheral faces of each said sabot segment enclose an angle of 60° and each planar peripheral face is disposed at a right angle to a respective adjacent segment separating face.

9. A sabot as defined in claim 5, wherein each sabot segment has a rounded circumferential region between its planar peripheral faces.

10. A sabot as defined in claim 1, wherein each sabot segment has at least two slightly outwardly curved circumferential faces and a more highly curved circumferential region disposed between said slightly curved circumferential faces.

11. A sabot as defined in claim 1, wherein said sabot segments are shaped so that said sabot has a front guide flange and a rear pressure flange, said non-caliber sized partial region lies between said front guide flange and said rear pressure flange, said polygonal cross-sectional shape is provided only within a portion of said partial region between the front guide flange and the rear pressure flange, and said sabot is rotationally symmetrical in a sub-region of said partial region immediately behind said front guide flange and in a sub-region of said partial region immediately in front of said rear pressure flange when said sabot is viewed in a direction from said front guide flange toward said rear pressure flange.

12. A sabot as defined in claim 11, wherein the portion of said partial region having the polygonal cross-sectional shape is less than 80% of the distance between said front guide flange and said rear pressure flange.

13. A sabot as defined in claim 11, wherein the portion of said partial region having the polygonal cross-sectional shape is less than 60% of the distance between said front guide flange and said rear pressure flange.

14. A sabot as defined in claim 5, wherein said sabot has a central longitudinal axis and the planar peripheral faces of each sabot segment extend in the longitudinal direction of said sabot slightly obliquely to the longitudinal axis of said sabot.

15. A sabot as defined in claim 2, wherein the partial region of said sabot containing the essentially triangular cross-sectional shape presents three exterior faces which are slightly convexly curved toward the exterior of said sabot.

16. A sabot as defined in claim 15, wherein each said exterior face is terminated by two outer corner points, and the curvature of each said exterior face meets the geometric condition that b is equal to or less than a, where b is equal to the maximum distance of the curved exterior face from a straight line taken between the terminating two outer corner points of the curved exterior face and a is equal to the maximum distance between the curved exterior face and a circle defined by all of the outer corner points of said sabot segments.

17. A sabot as defined in claim 15, wherein said sabot has a central longitudinal axis and each sabot segment, when seen in cross section, includes two adjacent, slightly curved peripheral faces and a short arcuate surface between said two adjacent, slightly curved peripheral faces, said arcuate surface having a radius of curvature with a center of origin located on the central longitudinal axis of said sabot which also forms the line of intersection of planes defined by said segment separating faces.

18. A sabot as defined in claim 17, wherein said segment separating faces have a length C and, when seen in cross section, each said arcuate surface has a length in the peripheral direction that is smaller than or equal to the length C of the segment separating faces.

19. A segmented, discardable sabot for a slender sub-caliber kinetic energy projectile, comprising:

four sabot segments having adjacent, plane parallel segment separating faces, said sabot segments forming at least one caliber-sized gas-sealing pressure flange member and at least one sub-caliber partial region along the longitudinal extent of said sabot, wherein the overall cross section of said sabot has an essentially square cross-sectional shape at least in said partial region for providing increased bending stiffness of said sabot in the partial region.

20. A sabot as defined in claim 19, wherein, when seen in cross section, the essentially square cross section of said sabot in said partial region has four exterior faces which are slightly convexly curved outwardly.

21. A sabot as defined in claim 20, wherein said sabot has a central longitudinal axis and each sabot segment, when seen in cross section, has two adjacent, slightly curved peripheral faces and a short arcuate surface disposed between said two adjacent faces, the radius of curvature of each said arcuate surface having its center of origin located on the longitudinal axis of said sabot.

* * * * *